US008754019B2

(12) United States Patent
Tsubouchi et al.

(10) Patent No.: US 8,754,019 B2
(45) Date of Patent: Jun. 17, 2014

(54) PRESSURE TRANSMISSION MEDIUM AND HYDRAULIC DEVICE

(75) Inventors: Toshiyuki Tsubouchi, Sodegaura (JP); Yoshio Hironaka, Sodegaura (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 153 days.

(21) Appl. No.: 13/000,722

(22) PCT Filed: Jul. 8, 2009

(86) PCT No.: PCT/JP2009/062433

§ 371 (c)(1),
(2), (4) Date: Dec. 22, 2010

(87) PCT Pub. No.: WO2010/005022

PCT Pub. Date: Jan. 14, 2010

(65) Prior Publication Data

US 2011/0105373 A1 May 5, 2011

(30) Foreign Application Priority Data

Jul. 8, 2008 (JP) ..... 2008-177976

(51) Int. Cl.
*C10M 129/68* (2006.01)

(52) U.S. Cl.
USPC ..... 508/478

(58) Field of Classification Search
USPC ..... 508/478
See application file for complete search history.

(56) References Cited

U.S. PATENT DOCUMENTS

| | | | | |
|---|---|---|---|---|
| 2,351,280 | A | 6/1944 | Morgan | |
| 3,133,021 | A * | 5/1964 | Gisser et al. | 508/262 |
| 3,492,362 | A | 1/1970 | Nettesheim | |
| 3,555,057 | A | 1/1971 | Parker et al. | |
| 4,036,984 | A | 7/1977 | Takahashi et al. | |
| 4,892,680 | A | 1/1990 | Ishida | |
| 7,959,824 | B2 * | 6/2011 | Tagawa et al. | 252/68 |
| 2003/0032563 | A1 * | 2/2003 | Tazaki | 508/459 |
| 2010/0130394 | A1 * | 5/2010 | Tsubouchi | 508/478 |

FOREIGN PATENT DOCUMENTS

| | | | |
|---|---|---|---|
| CN | 1871329 | A | 11/2006 |
| CN | 1938408 | A | 3/2007 |
| EP | 1 780 258 | A1 | 5/2007 |
| FR | 2154524 | | 5/1973 |
| FR | 2706169 | A1 * | 12/1994 |
| JP | 48 37568 | | 6/1973 |
| JP | 1 287061 | | 11/1989 |
| JP | 1 316340 | | 12/1989 |
| JP | 6 200277 | | 7/1994 |
| JP | 8 259520 | | 10/1996 |
| JP | 2000 119672 | | 4/2000 |
| JP | 2003 119482 | | 4/2003 |
| JP | 2006 306986 | | 11/2006 |
| WO | WO 2008/133233 | A1 | 11/2008 |
| WO | WO 2008133233 | A1 * | 11/2008 |

OTHER PUBLICATIONS

Extended European Search Report issued on Mar. 26, 2012 in the corresponding European Application No. 09794466.4.

Timothy D. Lash, et al., "Normal and Abnormal Heme Biosynthesis. 2. 1 Synthesis and Metabolism of Type-III Pentacarboxylic Porphyrinogens: Further Experimental Evidence for the Enzymic Clockwise Decarboxylation of Uroporphyrinogen-III", The Journal of Organic Chemistry, vol. 64, No. 2, XP55020822, Jan. 1, 1999, pp. 478-487.

Jaime De La Zerda, et al., "Selective Monoetherification and Monoesterification of Diols and Diacids Under Phase-Transfer Conditions", Tetrahedron, vol. 45, No. 5, XP002072626, Jan. 1, 1989, pp. 1533-1536.

International Search Report issued Oct. 6, 2009 in PCT/JP09/062433 filed Jul. 8, 2009.

Portnoy, S. et al., "Esters of Aromatic Alcohols and Dibasic Acids as Base Stocks for Nonspreading Oil Compositions", Chemical and Engineering Data Series, pp. 287-293 (1958).

Reith, H. et al. "Darstellung and Physikalisch-Cjhemische Untersuchung Homologer von Dicrbonsaeureestern mit Besonderer Beruecksichtigung der Verwendbarkeit als *Schmierstoffe*", Freiberger Forschungshefte, No. 250, pp. 39-86, (1962) (with partial English translation).

Goldman, I. B. et al., "The Compressibility of Selected Fluids at Pressures Up to 230,000 PSI" Lubricating Engineering, No. 27, pp. 334-341 (Oct. 1971).

Office Action issued Feb. 5, 2013 in Chinese Patent Application No. 200980125939.8 (with English translation).

Huang Hao, et al., "The Kinds and Application of Fire Resistant and Environmental Protection Hydraulic Oil", Fire resistant; Environmental Protection; Hydraulic Oil, 2004, No. 12, pp. 108-109 (with English abstract).

* cited by examiner

*Primary Examiner* — Taiwo Oladapo
(74) *Attorney, Agent, or Firm* — Oblon, Spivak, McClelland, Maier & Neustadt, L.L.P.

(57) ABSTRACT

A pressure transmission medium contains an ester or an ether having two or more ring structures of an aromatic ring or a saturated naphthenic ring as a pressure transmission medium base oil. The pressure transmission medium that exhibits low energy loss due to compression, excellent response in a hydraulic circuit, energy-saving, high-speed operation and high precision of control in a hydraulic circuit, a low viscosity and a low churning resistance, and a hydraulic device can be provided.

8 Claims, No Drawings

PRESSURE TRANSMISSION MEDIUM AND HYDRAULIC DEVICE

RELATED APPLICATION

This application is a national stage entry of PCT/JP2009/062433, filed Jul. 8, 2009, which claims foreign priority from Japanese Patent Application No. 2008-117976, filed Jul. 8, 2008, which is incorporated by reference in its entirety.

TECHNICAL FIELD

The present invention relates to a pressure transmission medium having a high bulk modulus and a hydraulic device using the pressure transmission medium.

BACKGROUND ART

A variety of hydraulic devices using hydraulic fluids such as a construction machine, an injection molding machine, a press machine, a crane and a machining center have been widely used. A variety of oils have been used in these hydraulic devices (see, for instance, Patent Literature 1 or 2).

Patent Literature 1 discloses a hydraulic fluid for a vibration suppression damper that has bulk modulus of 1.3 or more, a viscosity index of 110 or more and a pour point of minus 25 degrees C. or less and is specifically arranged to include poly α-olefin, polyol ester and polyether.

Patent Literature 2 discloses a lubricating oil, e.g. a compressor oil, a turbine oil and a hydraulic fluid, that is used for a lubricating system requiring a large working load, and is arranged to include alkyl diphenyl and alkyl diphenyl ether.

CITATION LIST

Patent Literatures

Patent Literature 1: JP-A-2000-119672
Patent Literature 2: JP-A-6-200277

SUMMARY OF THE INVENTION

Problems to be Solved by the Invention

When a working pressure applied on a hydraulic fluid to be used becomes 20 MPa or more in a hydraulic device, unignorable amount of energy loss is caused on account of decrease in volume of the hydraulic fluid by compression. A volume change rate of the fluid by compression and power loss (energy loss) rate in accordance with the volume change rate are represented by the following formulae (I) and (II), in which P represents compression pressure and K represents bulk modulus.

$$\text{Volume change rate}=\Delta P/K \quad \text{(I)}$$

$$\text{Power loss rate}=\Delta P/(2K) \quad \text{(II)}$$

For instance, when a mineral oil having bulk modulus K of 1.4 GPa is used at 28 MPa, according to the above formulae (I) and (II), a volume change rate is decreased by 2% and hydraulic energy is maintained as 1% elastic energy in the mineral oil, but the elastic energy is not recovered and ends up in energy loss. Especially, in an axial piston pump in which a concave piston is provided for decreasing an inertial weight, such an arrangement that dead volume is set to be the same as discharge volume even in full stoke has been widely used, which causes 2% energy loss. With an arrangement of a variable stroke pump operating at a constant pressure or at a constant force, operation will be mostly at a high pressure and with a low stroke volume. Accordingly, discharge volume is decreased and dead volume is increased, whereby power loss reaches a 10% level of maximum rated input in a short time.

On the other hand, performance of a servo hydraulic control circuit is almost determined by a response speed and stability and depends on a natural angular frequency $\omega_0$ and a damping coefficient D of a control loop in the servo hydraulic control circuit. Since both the natural angular frequency $\omega_0$ and the damping coefficient D are preferably large and are in direct proportion to bulk modulus $K^{1/2}$, increase in the K value of a hydraulic fluid leads to high-speed operation in the hydraulic circuit and high precision of hydraulic control.

From the above, it is recognized that the K value of the hydraulic fluid is required to be set high. However, mineral oil compounds and fatty acid ester compounds that have been typically used and a typical base oil for a hydraulic fluid disclosed in Patent Literature 1 exhibit a low bulk modulus. On the other hand, water hydraulic fluids and phosphate compounds exhibit poor lubricity and thermal stability although exhibiting relatively high bulk modulus, so that the water hydraulic fluids and the phosphate compounds are unusable under such severe conditions at a high temperature and a high pressure. Among other synthetic lubricating base oils, diphenyl and a diphenyl ether compound having an alkyl group with carbon atoms of 10 or more as disclosed in Patent Literature 2 exhibit a low bulk modulus. Polyphenyl ether having a high bulk modulus exhibits a low viscosity index, poor low-temperature fluidity and is more expensive than other compounds, so that polyphenyl ether is not suitable for use.

In view of the above points, an object of the present invention is to provide a pressure transmission medium that exhibits a high bulk modulus and an excellent efficiency, and a hydraulic device using the pressure transmission medium.

Means for Solving the Problems

In an aspect of the invention, a pressure transmission medium includes at least one of an ester and an ether, in which the at least one of the ester and the ether has two or more ring structures of an aromatic ring or a saturated naphthenic ring and exhibits a kinematic viscosity at 40 degrees C. of 15 $mm^2/s$ or less.

In the aspect of the invention, since the pressure transmission medium to be used has two or more ring structures of the aromatic ring or saturated naphthenic ring and exhibits a kinematic viscosity at 40 degrees C. of 15 $mm^2/s$ or less to exhibit high bulk modulus, lubricity and thermal stability, low energy loss due to compression, excellent response when being used, for instance, in a hydraulic circuit, and energy-saving, high-speed operation and high precision of control in the hydraulic circuit are obtained. Specifically, a lower limit of the kinematic viscosity at 40 degrees C. is preferably 3 $mm^2/s$ or more. The kinematic viscosity at 40 degrees C. of 3 $mm^2/s$ or more is preferable because leakage of the pressure transmission medium from the sealing portion can be reduced. Moreover, high density of the pressure transmission medium results in a small difference between a concentration of dissolved gas under increased pressure and a concentration of dissolved gas under ambient pressure, so that less air bubbles are formed, for example, in a reservoir tank. Even if air bubbles are formed, a difference in specific gravity between the pressure transmission medium and the air bubbles is large, thereby facilitating air bubble separation. Accordingly, decrease in control of hydraulic pressure, occurrence of cavitation and erosion caused by formation of air bubbles can be prevented. Further, the pressure transmission medium exhibits small churning resistance due to low viscosity to excel in energy saving. As noted above, the compound according to the aspect of the invention is highly effective also in a low-pressured hydraulic circuit and is excellent in applicability.

In the aspect of the invention, the ester is preferably dibasic acid diester.

Examples of dibasic acid diester are oxalic acid diester, malonic acid diester, succinic acid diester, adipic acid diester, and azelaic acid diester.

In the aspect of the invention, since dibasic acid diester is used in the pressure transmission medium, the pressure transmission medium is easily manufactured and is excellent in viscosity characteristics. Further, the pressure transmission medium exhibits small churning resistance due to low viscosity to excel in energy saving. As noted above, the compound according to the aspect of the invention is highly effective also in a low-pressured hydraulic circuit and is excellent in applicability.

In the aspect of the invention, the ester is preferably formed by a carboxylic acid having the aromatic ring or the saturated naphthenic ring and an alcohol having the aromatic ring or the saturated naphthenic ring.

In the aspect of the invention, since the ester formed by the carboxylic acid having the aromatic ring or saturated naphthenic ring and alcohol having the aromatic ring or saturated naphthenic ring is used in the pressure transmission medium, the pressure transmission medium is easily manufactured. Moreover, the pressure transmission medium can realize low energy loss due to compression, excellent response when being used, for instance, in a hydraulic circuit, and energy-saving, high-speed operation and high precision of control. Moreover, high density of the pressure transmission medium results in a small difference between a concentration of dissolved gas under increased pressure and a concentration of dissolved gas under ambient pressure, so that less air bubbles are formed, for example, in a reservoir tank. Even if air bubbles are formed, a difference in specific gravity between the pressure transmission medium and the air bubbles is large, thereby facilitating air bubble separation. Accordingly, decrease in control of hydraulic pressure, occurrence of cavitation and erosion caused by formation of air bubbles can be prevented. Further, the pressure transmission medium exhibits small churning resistance due to low viscosity to excel in energy saving.

As noted above, the compound according to the aspect of the invention is highly effective also in a low-pressured hydraulic circuit and is excellent in applicability.

In the aspect of the invention, the ester is any one of esters selected from the group consisting of: an ester formed by a carboxylic acid having an ether bond and an alcohol having no ether bond; an ester formed by a carboxylic acid having no ether bond and an alcohol having an ether bond; and an ester formed by a carboxylic acid having an ether bond and an alcohol having an ether bond.

In the aspect of the invention, since any one of esters selected from the group consisting of: an ester formed by a carboxylic acid having an ether bond and an alcohol having no ether bond; an ester formed by a carboxylic acid having no ether bond and an alcohol having an ether bond; and an ester formed by a carboxylic acid having an ether bond and an alcohol having an ether bond is used in the pressure medium, the pressure transmission medium is easily manufactured and is excellent in viscosity characteristics. Further, the pressure transmission medium exhibits small churning resistance due to low viscosity to excel in energy saving.

As noted above, the compound according to the aspect of the invention is highly effective also in a low-pressured hydraulic circuit and is excellent in applicability.

In the aspect of the invention, the ester is preferably a carbonate ester.

In the aspect of the invention, since the carbonate ester is used in the pressure transmission medium, the pressure transmission medium is easily manufactured and is excellent in viscosity characteristics. Further, the pressure transmission medium exhibits small churning resistance due to low viscosity to excel in energy saving. As noted above, the compound according to the aspect of the invention is highly effective also in a low-pressured hydraulic circuit and is excellent in applicability.

A hydraulic device according to another aspect of the invention uses the above-described pressure transmission medium of the invention.

In the aspect of the invention, the pressure transmission medium including an ester or ether as the base oil is applicable for the hydraulic device.

DESCRIPTION OF EMBODIMENTS

A preferred exemplary embodiment for implementing the invention is described below. In the exemplary embodiment, the invention is exemplarily applied to a hydraulic fluid used in a hydraulic circuit of a relatively high-pressure hydraulic device such as a construction machine, injection molding machine, press machine, crane, machining center and the like. However, the invention is also suitably applicable to a hydraulic circuit in a low-pressure hydraulic device and further to a servo hydraulic control circuit.

Composition of Pressure Transmission Medium

A pressure transmission medium in the exemplary embodiment contains pressure transmission base oil and an additive.

<Pressure Transmission Base Oil>

The pressure transmission base oil contains an ester or ether having two or more ring structures of an aromatic ring or saturated naphthenic ring.

A manufacturing method of the ester or ether having two or more ring structures of the aromatic ring or the saturated naphthenic ring is not particularly limited. A variety of typical manufacturing methods for esterification or etherification are applicable.

For instance, a carboxylic acid, carboxylic acid ester, carboxylic acid chloride, alcohol or derivative thereof are used as the raw material. Specific examples of a usable dicarboxylic acid are oxalic acid, malonic acid, succinic acid, adipic acid, and azelaic acid. Specific examples of a usable carboxylic acid are benzoic acid, toluic acid, phenylacetic acid, phenoxyacetic acid, anisic acid, salicylic acid, and cyclohexane carboxylic acid. Examples of alcohol to be used are phenol, cresol, xylenol, benzyl alcohol, phenethyl alcohol, phenoxyethanol, benzyl oxyethanol, diethylene glycol monobenzyl ether, cyclohexanol, methyl cyclohexanol, cyclohexane methanol, and norbornane methanol.

The aromatic ring or naphthenic ring may be substituted by an alkyl group, a nitro group, a hydroxyl group or an alkoxy group as a substituent. A raw material containing these substituents is typically used. However, when being substituted by an alkyl group, the raw material may be initially esterified, followed by alkylation. Alternatively, an initially alkylated raw material may be used.

An esterification catalyst is not particularly limited. Alternatively, no catalyst may be used for esterification.

A manufacturing method of an ether compound is not limited to a typical Williamson synthesis method. A carboxylic acid having an ether bond such as phenoxyacetic acid, phenoxyethanol, benzyl oxyethanol and diethylene glycol monobenzyl ether, or alcohol having an ether bond may be used as a raw material for esterification.

The base oil includes the ester or ether having two or more ring structures of the aromatic ring or the saturated naphthenic ring of 10 mass % or more, preferably 30 mass % or more, more preferably 40 mass % or more.

When the ester or ether is less than 10 mass %, there may be little advantage that bulk modulus is increased. Accordingly, the base oil includes the ester or ether having two or more ring structures of the aromatic ring or the saturated naphthenic ring of 10 mass % or more, preferably 30 mass % or more, more preferably 40 mass % or more.

<Additives>

A variety of additives can be added to the pressure transmission medium as needed, as long as an object of the invention is obtained, in other words, the pressure transmission medium exhibits a high bulk modulus and reduces energy loss when used in the hydraulic circuit to provide a favorable working efficiency.

Examples of the additives include a viscosity index improver, an antioxidant, a detergent dispersant, a friction modifier, a metal deactivator, a pour point depressant, an antiwear agent, an antifoaming agent, and an extreme pressure agent.

Examples of the viscosity index improver include: polymethacrylate; an olefin copolymer such as an ethylene-propylene copolymer; a dispersant type olefin copolymer; a styrene copolymer such as a hydrogenated styrene-diene copolymer. The viscosity index improvers may be used alone or in a combination of two or more. The viscosity index improvers are typically added in a range of 0.5 mass % to 10 mass %.

Examples of the antioxidant include a phenol antioxidant such as 2,6-di-t-butyl-4-methylphenol and 4,4'-methylenebis-(2,6-di-t-butylphenol), an amine antioxidant such as alkylated diphenylamine, phenyl-α-naphthylamine and alkylated-α-naphthylamine, dialkylthiodipropionate, dialkyldithiocarbamate derivative (except a metal salt), bis(3,5-di-t-butyl-4-hydroxybenzil)sulfide, mercaptobenzothiazole, a reaction product of phosphorus pentasulfide and olefin and a sulfur antioxidant such as dicetyl sulfide. The antioxidants are used alone or in combination of two or more. Particularly, the phenol antioxidant, the amine antioxidant or zinc alkyldithio phosphate, and a mixture thereof are preferably used. The antioxidants are typically added in a range of 0.1 mass % to 10 mass %.

The detergent dispersant is exemplified by alkenyl succinimide. The detergent dispersant is typically added in a range of 0.1 mass % to 10 mass %.

The metal deactivator is exemplified by benzotriazole and thiadiazole, which may be used alone or in a combination of two or more. The metal deactivators are typically added in a range of 0.1 mass % to 5 mass %.

The pour point depressant is exemplified by polymethacrylate. The pour point depressant is typically added in a range of 0.5 mass % to 10 mass %.

The antiwear agent is exemplified by zinc alkyldithio phosphate. The antiwear agent is typically added in a range of 0.1 mass % to 10 mass %.

The antifoaming agent is exemplified by a silicone compound and an ester compound, which may be used alone or in a combination of two or more. The antifoaming agent is typically added in a range of 0.01 mass % to 1 mass %.

The extreme pressure agent is exemplified by tricresyl phosphate. The extreme pressure agent is typically added in a range of 0.1 mass % to 10 mass %.

Advantages of Hydraulic Fluid

According to the above exemplary embodiment, the base oil includes the ester or ether having two or more ring structures of the aromatic ring or the saturated naphthenic ring.

Accordingly, since the ester or ether having two or more aromatic rings which exhibits a high bulk modulus, lubricity and thermal stability is used as the base oil, low energy loss due to compression, excellent response when being used, for instance, in a hydraulic circuit of a hydraulic device, and energy-saving, high-speed operation and high precision of control in the hydraulic circuit are obtained. Moreover, high density of the pressure transmission medium results in a small difference between a concentration of dissolved gas under increased pressure and a concentration of dissolved gas under ambient pressure, so that less air bubbles are formed, for example, in a reservoir tank. Even if air bubbles are formed, a difference in specific gravity between the pressure transmission medium and the air bubbles is large, thereby facilitating air bubble separation. Accordingly, decrease in control of hydraulic pressure, occurrence of cavitation and erosion caused by formation of air bubbles can be prevented. Further, the pressure transmission medium exhibits small churning resistance due to low viscosity to excel in energy saving. Thus, the compound according to the aspect of the invention is highly effective also in a low-pressured hydraulic circuit and is excellent in applicability.

When the compound according to the invention is used in a hydraulic device, it is desirable that an organic material for a sealing material and the like has a composition excellent in anti-swellability.

The pressure transmission medium base oil includes an ester or ether having two or more ring structures of the aromatic ring or the saturated naphthenic ring of 10 mass % or more, preferably 30 mass % or more, more preferably 40 mass % or more.

Accordingly, a unique advantage, i.e., increase in bulk modulus, is provided.

Modification(s) of Embodiment(s)

It should be noted that the embodiment described above is only an exemplary embodiment of the invention. The invention is not limited to the above-described embodiment but includes modifications and improvements as long as the object and the advantages of the aspect of the invention can be attained. Further, the specific arrangements and configurations may be altered in any manner as long as the modifications and improvements are compatible with the invention.

Specifically, the pressure transmission medium of the invention includes 10 mass % or more of the ester or ether having two or more ring structures of the aromatic ring or the saturated naphthenic ring as the base oil, but not limited to this.

Although an arrangement in which the additive is added as needed is exemplified, the additive may not be used.

The specific composition and the like in the aspect of the invention may be designed in any manner as long as an object of the invention can be achieved.

EXAMPLES

Next, the invention will be described in more detail below with reference to examples and comparative examples.

The invention should not be construed as limited to what is described in the examples and the like.

Preparation of Samples

Experiments were carried out to check properties of the hydraulic fluid in the above-mentioned exemplary embodiment. In the experiment, by using various hydraulic fluids prepared under the following conditions, properties of respective hydraulic fluids, i.e. a kinematic viscosity, viscosity index, density, pour point and tangential bulk modulus, were measured and evaluated in comparison.

A kinematic viscosity was measured by a method of JIS (Japanese Industrial Standards) K 2283 and a viscosity index was calculated by the method of JIS K 2283.

A density was measured by a method of JIS K 2249.

A pour point was measured by a method of JIS K 2269.

Tangential bulk modulus was a value at 40 degrees C. and 50 MPa obtained by high-pressure density measurement. In high-pressure density measurement, using a plunger type high-pressure densimeter by Saga University as described below, pressure was applied from ambient pressure to 200 MPa in a stepwise manner and measurement was carried out at 40 degrees C. A volume of the hydraulic fluid in a container was obtained by detecting a displacement of a plunger with a linear gauge.

cylinder: made of Ni—Cr—Mo steel, outer diameter of 80.0 mm, inner diameter of 29.93 mm plunger and plug: made of Cr—Mo steel high-pressure seal: made of beryllium copper Results of these properties are shown in Tables 4 and 5. Moreover, a 28-day biodegradability test (biodegradability: BOD) according to JIS K6950 was conducted on the fluid by using BOD tester 200F (manufactured by TAITEC Co., Ltd.), a result of the test being also shown in Tables 4 and 5.

Example 1

To a 1-liter four necked flask equipped with Dean Stark apparatus, 50 g of malonic acid (manufactured by Tokyo Chemical Industry Co., Ltd.: reagent), 125 g of benzyl alcohol (manufactured by Tokyo Chemical Industry Co., Ltd.: reagent), 40 g of 2-phenoxyethanol (manufactured by Tokyo Chemical Industry Co., Ltd.: reagent), 80 ml of mixed xylene (manufactured by Tokyo Chemical Industry Co., Ltd.: reagent), and 0.1 g of titanium tetraisopropoxide (manufactured by Tokyo Chemical Industry Co., Ltd.: reagent) were added and reacted with stirring at 160 degrees C. for 2 hours under nitrogen stream while distilling water. Subsequently, washing by saturated brine and washing by 0.1 N aqueous sodium hydroxide were respectively conducted three times, followed by being dried by anhydrous magnesium sulfate (manufactured by Tokyo Chemical Industry Co., Ltd.: reagent). After the magnesium sulfate was filtered, excessive alcohol was distilled to obtain 120 g of an ester mixture of dibenzyl ester (62%), benzyl phenoxy ester (31%) and diphenoxy ester (7%).

Example 2

In the same manner as in Example 1 except for using 25 g of malonic acid, 28 g of succinic acid and 156 g of benzyl alcohol in place of 50 g of malonic acid, 125 g of benzyl alcohol and 40 g of 2-phenoxyethanol, 121 g of a mixture of dibenzyl malonate (50%) and dibenzyl succinate (50%) was obtained.

Example 3

In the same manner as in Example 2 except for using 146 g of o-anisic acid in place of 25 g of malonic acid and 28 g of succinic acid, 214 g of benzyl o-anisate was obtained.

Example 4

To a 500-ml four necked flask equipped with Dean Stark apparatus, 28.4 g of diethyl carbonate, 43.5 g of benzyl alcohol, 20.4 g of 2-benzyloxyethanol, 18.5 g of phenoxyethanol, and 0.1 g of tetraisopropyl titanate were added and reacted with stirring at 120 degrees C. for approximately 8 hours under nitrogen stream while distilling alcohol. When it was confirmed that ethanol was not distilled any more, the reaction was finished. After cooled down, the reaction product was put into a separating funnel and diluted with 50 ml of toluene. Subsequently, washing by saturated brine and washing by 0.1 N aqueous sodium hydroxide were respectively conducted three times, followed by being dried by anhydrous magnesium sulfate. After magnesium sulfate was filtered, a solvent was distilled by a rotary evaporator. Then, excessive unreacted alcohol, the solvent and the like were distilled under reduced pressure with a vacuum pump. Complete distillation was confirmed by gas chromatography (GC). 65.2 g of a carbonate ester mixture as a target was obtained as a residue by evaporating a concentrated product with the evaporator. A composition of the ester mixture is shown in Table 1 below.

TABLE 1

| Terminal Substituents | | |
|---|---|---|
| R1 | R2 | Rate (%) |
| benzyl | benzyl | 36 |
| benzyl | 2-phenoxyethyl | 22 |
| benzyl | 2-benzyloxyethyl | 27 |
| 2-phenoxyethyl | 2-phenoxyethyl | 3 |
| 2-phenoxyethyl | 2-benzyloxyethyl | 8 |
| 2-benzyloxyethyl | 2-benzyloxyethyl | 4 |

R1—OOC—COO—R2

Example 5

To a 500-ml four necked flask equipped with Dean Stark apparatus, 13.5 g of oxalic acid (manufactured by Wako Pure Chemical Industries, Ltd: reagent), 22.8 g of 2-benzyloxyethanol, 100 ml of mixed xylene and 0.1 g of titanium tetraisopropoxide were added and reacted with stirring at 140 degrees C. for 3 hours under nitrogen stream while distilling water. Next, 9.7 g of benzyl alcohol, 9.3 g of 2-phenoxyethanol, 8.8 g of 2-ethylhexanol and 0.1 g of titanium tetraisopropoxide were added and reacted with being further heated for approximately 8 hours until no distillation of water was confirmed. After cooled down, 100 ml of toluene was added with stirring. Subsequently, washing by saturated brine and washing by 0.1 N aqueous sodium hydroxide were respectively conducted three times, followed by being dehydrated to be dried by anhydrous magnesium sulfate. After magnesium sulfate was filtered, excessive alcohol, monoester and a solvent were distilled under reduced pressure to obtain a 20.0 g of a mixed ester of oxalic acid. A composition of the ester mixture is shown in Table 2 below.

TABLE 2

| Terminal Substituents | | |
|---|---|---|
| R1 | R2 | Rate (%) |
| 2-ethylhexyl | 2-ethylhexyl | 8 |
| 2-ethylhexyl | benzyl | 16 |
| benzyl | benzyl | 8 |
| 2-ethylhexyl | 2-phenoxyethyl | 8 |
| benzyl | 2-phenoxyethyl | 24 |
| benzyl | 2-benzyloxyethyl | 17 |
| 2-phenoxyethyl | 2-phenoxyethyl | 2 |
| 2-phenoxyethyl | 2-benzyloxyethyl | 6 |
| 2-benzyloxyethyl | 2-benzyloxyethyl | 10 |
| others | | 1 |

R1—OCOO—R2

Example 6

To a 500-ml four necked flask equipped with Dean Stark apparatus, 28.3 g of succinic acid (manufactured by Wako Pure Chemical Industries, Ltd: reagent), 38.9 g of benzyl alcohol, 14.9 g of 2-phenoxyethanol, 22.2 g of neopentyl alcohol, 100 ml of mixed xylene and 0.2 g of titanium tetraisopropoxide were added and reacted with stirring at 160 degrees C. for 8 hours under nitrogen stream while distilling water. The reaction product was diluted with 50 ml of toluene. Subsequently, washing by saturated brine and washing by 0.1 N aqueous sodium hydroxide were respectively conducted three times, followed by being dried by anhydrous magnesium sulfate. After magnesium sulfate was filtered, excessive alcohol, a solvent and the like were distilled under reduced pressure to obtain 22.2 g of a mixed ester of succinic acid. A composition of the ester mixture is shown in Table 3 below.

TABLE 3

| Terminal Substituents | | |
|---|---|---|
| R1 | R2 | Rate (%) |
| neopentyl | neopentyl | 5 |
| neopentyl | benzyl | 29 |
| neopentyl | 2-phenoxyethyl | 10 |
| benzyl | benzyl | 30 |
| benzyl | 2-phenoxyethyl | 22 |
| 2-phenoxyethyl | 2-phenoxyethyl | 4 |

R1—OOC$(CH_2)_2$COO—R2

Example 7

To a 500-ml four necked flask equipped with Dean Stark apparatus, 39.3 g of diethylene glycol monobenzyl ether, 40.8 g of methyl benzoate, and 0.2 g of titanium tetraisopropoxide were added and heated with stirring at 150 degrees C. for 9 hours under nitrogen stream until no methanol is confirmed. The reaction product was diluted with 50 ml of toluene. Subsequently, washing by saturated brine and washing by 0.1 N aqueous sodium hydroxide were respectively conducted three times, followed by being dried by anhydrous magnesium sulfate. After magnesium sulfate was filtered, excessive alcohol, a solvent and the like were distilled under reduced pressure to obtain 44.9 g of an ester (target). As a result of a measurement by a mass spectrometer, the ester was recognized as benzyloxy-ethoxy-ethyl benzoate having a molecular weight of 300.

Comparative Example 1

A paraffinic mineral oil (manufactured by Idemitsu Kosan Co., Ltd.: product name; Diana Fresia P90), regarded as Comparative Example 1, was similarly measured with respect to the properties.

Comparative Example 2

Polybutene (manufactured by Idemitsu Kosan Co., Ltd.: product name; Idemitsu Polybutene 5H), regarded as Comparative Example 2, was similarly measured with respect to the properties.

Comparative Example 3

To a 2-liter four necked flask equipped with Dean Stark apparatus, 218 g of anhydrous pyromellitic acid, 650 g of n-octanol, 0.2 g of titanium tetraisopropoxide and 300 cc of xylene were added and reacted with stirring at 160 degrees C. for 4 hours under nitrogen stream while distilling water. Subsequently, washing by saturated brine and washing by 0.1 N aqueous sodium hydroxide were respectively conducted three times, followed by being dried by anhydrous magnesium sulfate. After magnesium sulfate was filtered, unreacted alcohol was distilled under reduced pressure to obtain 630 g of tetraoctyl pyromellitate. Tetraoctyl pyromellitate, regarded as Comparative Example 3, was similarly measured with respect to the properties.

Comparative Example 4

Alkyl diphenyl ether (manufactured by MATSUMURA OIL RESEARCH CORP.: product name; MORESCO-HI-LUBE LB-68), regarded as Comparative Example 4, was similarly measured with respect to the properties.

Comparative Example 5

In the same manner as in Example 1 except for using 122 g of benzoic acid (manufacture by Tokyo Chemical Industry Co., Ltd.: reagent) and 230 g of Guerbet alcohol (manufactured by Sasol Japan K.K.: product name; ISOFOL 16) in place of 50 g of malonic acid, 125 g of benzyl alcohol and 40 g of 2-phenoxyethanol, 305 g of Guerbet alcohol ester of benzoic acid was obtained. Guerbet alcohol ester of benzoic acid, regarded as Comparative Example 5, was similarly measured with respect to the properties and biodegradability.

TABLE 4

| Item | Example 1 | Example 2 | Example 3 | Example 4 | Example 5 | Example 6 | Example 7 |
|---|---|---|---|---|---|---|---|
| Kinematic viscosity at 40° C. ($mm^2/s$) | 14.04 | 11.66 | 10.85 | 11.68 | 13.31 | 13.76 | 11.60 |
| Kinematic viscosity at 100° C. ($mm^2/s$) | 3.02 | 2.850 | 2.438 | 2.697 | 2.872 | 2.885 | 2.815 |
| Viscosity index | 48 | 85 | 6 | 47 | 36 | 24 | 79 |

TABLE 4-continued

| Item | Example 1 | Example 2 | Example 3 | Example 4 | Example 5 | Example 6 | Example 7 |
|---|---|---|---|---|---|---|---|
| Density at 15° C. (g/ml) | 1.1764 | 1.1599 | 1.1653 | 1.1527 | 1.1089 | 1.1058 | 1.1238 |
| Pour point (° C.) | −32.5 | −25 | −45 | −45 | −32.5 | −32.5 | −45 |
| Tangential bulk modulus (GPa) | 1.98 | 1.93 | 1.93 | 1.91 | 1.84 | 1.83 | 1.85 |
| Biodegradability (BOD) | 60% or more | 60% or more | 60% or more | 60% or more | 60% or more | 60% or more | — |

TABLE 5

| Item | Comparative Example 1 | Comparative Example 2 | Comparative Example 3 | Comparative Example 4 | Comparative Example 5 |
|---|---|---|---|---|---|
| Kinematic viscosity at 40° C.($mm^2/s$) | 89.79 | 95.7 | 69.14 | 68.52 | 11.79 |
| Kinematic viscosity at 100° C.($mm^2/s$) | 10.99 | 8.978 | 10.18 | 9.518 | 2.773 |
| Viscosity index | 108 | 52 | 132 | 118 | 62 |
| Density at 15° C.(g/ml) | 0.8716 | 0.8403 | 0.9175 | 0.9047 | 0.9271 |
| Pour point (° C.) | −17.5 | −30 | −5 | −30 or less | −47.5 |
| Tangential bulk modulus (GPa) | 1.51 | 1.44 | 1.56 | 1.54 | 1.56 |
| Biodegradability (BOD) | 10% or less | 10% or less | — | — | 60% or more |

As is understood from results of Tables 4 and 5, a paraffinic mineral oil in Comparative Example 1 and polybutene in Comparative Example 2, which are used as a lubricating oil, exhibit a low bulk modulus. The ester of Comparative Example 3 exhibits a low bulk modulus although a same ester it is. Further, the alkyldiphenyl ether of Comparative Example 4 also exhibits a low bulk modulus. Guerbet alcohol ester of Comparative Example 5 having low viscosity and biodegradability exhibits a low bulk modulus although a same aromatic ester it is.

On the other hand, each of the mixtures and the compounds of Examples 1 to 7 is applicable as a pressure transmission medium that exhibits a relatively low viscosity and pour point as well as a small churning resistance and excellent energy saving. Further, the each of the mixtures and the compounds has relatively high bulk modulus and small energy loss by compression, thereby providing effective operation in a hydraulic circuit.

The invention claimed is:

1. A pressure transmission medium, comprising:

an ester which comprises two or more ring structures of an aromatic ring or a saturated naphthenic ring, wherein the ester is an ester of a carboxylic acid having an aromatic ring or a saturated naphthenic ring and an alcohol having an aromatic ring or a saturated naphthenic ring, and a kinematic viscosity of the ester at 40 degrees C. is less than 15 $mm^2/s$; and wherein the ester is any one of esters selected from the group consisting of:

an ester formed by a carboxylic acid having an ether bond and an alcohol having no ether bond;

an ester formed by a carboxylic acid having no ether bond and an alcohol having an ether bond; and an ester formed by a carboxylic acid having an ether bond and an alcohol having an ether bond.

2. A hydraulic device comprising a pressure transmission medium, the pressure transmission medium, comprising:

a dibasic acid diester, wherein the dibasic acid diester comprises two or more ring structures of an aromatic ring or a saturated naphthenic ring and a kinematic viscosity of the dibasic acid diester at 40 degrees C. is less than 15 $mm^2/s$.

3. A hydraulic device comprising a pressure transmission medium, the pressure transmission medium, comprising:

an ester;

wherein the ester comprises two or more ring structures of an aromatic ring or a saturated naphthenic ring, the ester is an ester of a carboxylic acid having an aromatic ring or a saturated naphthenic ring and an alcohol having an aromatic ring or a saturated naphthenic ring, and a kinematic viscosity of the ester and at 40 degrees C. is less than 15 $mm^2/s$.

4. A hydraulic device comprising the pressure transmission medium according to claim 1.

5. A hydraulic device comprising a pressure transmission medium, the pressure transmission medium, comprising a carbonate ester;

wherein the carbonate ester comprises two or more ring structures of an aromatic ring or a saturated naphthenic ring, and a kinematic viscosity of the carbonate ester at 40 degrees C. is less than 15 $mm^2/s$.

6. A hydraulic device comprising a pressure transmission medium, the pressure transmission medium comprising:

a dibasic acid diester, wherein the dibasic acid diester comprises two or more ring structures of an aromatic ring or a saturated naphthenic ring, a kinematic viscosity of the dibasic acid diester at 40 degrees C. is less than 15 $mm^2/s$, and the dibasic acid of the diester is selected from the group consisting of oxalic acid, malonic acid, succinic acid, adipic acid and azelaic acid.

7. The hydraulic device according to claim 6, wherein an alcohol component of the dibasic acid diester is at least one selected from the group consisting of benzyl alcohol, benzyloxyethanol and phenoxyethanol.

8. A hydraulic device comprising a pressure transmission medium, the pressure transmission medium comprising a carbonate ester;

wherein the carbonate ester comprises two or more ring structures of an aromatic ring or a saturated naphthenic ring, a kinematic viscosity of the carbonate ester at 40 degrees C. is less than 15 $mm^2/s$, and an alcohol component of the carbonate ester is at least one selected from the group consisting of benzyl alcohol, benzyloxyethanol and phenoxyethanol.

* * * * *